US012485998B2

(12) United States Patent
Imam et al.

(10) Patent No.: US 12,485,998 B2
(45) Date of Patent: Dec. 2, 2025

(54) MOUNTING PLATE ASSEMBLY AND SYSTEM

(71) Applicant: SEAKEEPER, INC., California, MD (US)

(72) Inventors: Nabil I. Imam, Louisville, KY (US); Nicholas J. Troche, Columbia, PA (US); Dylan M. Froriep, Pine Beach, NJ (US)

(73) Assignee: SEAKEEPER, INC., Maryland, CA (US)

( * ) Notice: Subject to any disclaimer, the term of this patent is extended or adjusted under 35 U.S.C. 154(b) by 651 days.

(21) Appl. No.: 17/876,756

(22) Filed: Jul. 29, 2022

(65) Prior Publication Data

US 2023/0059065 A1 Feb. 23, 2023

Related U.S. Application Data

(60) Provisional application No. 63/235,988, filed on Aug. 23, 2021.

(51) Int. Cl.
*B63B 1/22* (2006.01)

(52) U.S. Cl.
CPC ..... *B63B 1/22* (2013.01)

(58) Field of Classification Search
CPC ..... B63B 1/22; B63B 1/32; B63B 2001/325; B63B 39/06; B63B 39/061
See application file for complete search history.

(56) References Cited

U.S. PATENT DOCUMENTS

| | | | |
|---|---|---|---|
| 3,058,442 | A | 10/1962 | Curtis |
| 4,524,942 | A | 6/1985 | Kueny |
| 4,749,926 | A | 6/1988 | Ontolchik |
| 5,142,497 | A | 8/1992 | Warrow |
| 5,263,432 | A | 11/1993 | Davis |
| 5,385,110 | A | 1/1995 | Bennett et al. |
| D362,841 | S | 10/1995 | Roza |
| 5,474,012 | A | 12/1995 | Yamada et al. |
| 6,041,730 | A | 3/2000 | Oliverio et al. |
| 6,268,053 | B1 | 7/2001 | Woiszwillo et al. |
| 6,273,771 | B1 | 8/2001 | Buckley et al. |
| 6,354,237 | B1 | 3/2002 | Gaynor et al. |
| 6,417,469 | B1 | 7/2002 | Tamura |

(Continued)

FOREIGN PATENT DOCUMENTS

| | | |
|---|---|---|
| AU | 200071946 A1 | 2/2001 |
| AU | 783746 B2 | 1/2003 |

(Continued)

OTHER PUBLICATIONS

US 11,198,496 B2, 12/2021, Wong et al. (withdrawn)

(Continued)

*Primary Examiner* — Anthony D Wiest

(57) ABSTRACT

An assembly adapted for mounting a water engagement device to a marine vessel may include a transom plate, an actuator plate and a clamping assembly. The transom plate may be adapted to be connected to the marine vessel. The actuator plate may include a flange that is disposed under a bottom side of the transom plate. The clamping assembly is configured to engage the transom plate and the actuator plate to connect the actuator plate to the transom plate.

17 Claims, 12 Drawing Sheets

(56) References Cited

U.S. PATENT DOCUMENTS 6,579,072 B2 6/2003 Trousil et al.
6,592,412 B1 7/2003 Geil et al.
6,651,574 B1 11/2003 Ellens et al.
6,659,816 B2 12/2003 Fuse
6,766,962 B2 7/2004 Paul et al.
6,874,441 B2 4/2005 Pigeon
D507,543 S 7/2005 Ishii et al.
6,928,948 B1 8/2005 Shannon
7,025,026 B2 4/2006 Young et al.
7,040,937 B2 5/2006 Scott et al.
7,059,347 B2 6/2006 Schwartzman
7,128,014 B2 10/2006 Berthiaume et al.
7,128,626 B2 10/2006 Dundra et al.
7,128,627 B2 10/2006 Ferguson
7,137,347 B2 11/2006 Wong et al.
7,140,315 B2 11/2006 Okuyama
7,156,708 B2 1/2007 Dudra
7,171,982 B2 2/2007 Dudra
7,258,072 B2 8/2007 Wong et al.
7,278,367 B1 10/2007 Gonring et al.
7,285,738 B2 10/2007 Lavigne et al.
7,311,058 B1 12/2007 Brooks et al.
7,318,386 B2 1/2008 Dudra et al.
D562,753 S 2/2008 Wall et al.
D562,754 S 2/2008 Wall et al.
7,364,482 B1 4/2008 Wong et al.
7,407,420 B1 8/2008 Fetchko et al.
7,479,607 B2 1/2009 Sack et al.
7,497,183 B2 3/2009 Dudra et al.
7,597,552 B2 10/2009 Young et al.
7,601,040 B2 10/2009 Morvillo
7,631,610 B1 12/2009 Wolske
7,641,525 B2 1/2010 Morvillo
7,717,462 B2 5/2010 Liu et al.
7,722,418 B2 5/2010 Ellens et al.
7,743,721 B2 6/2010 Barrett et al.
7,806,142 B2 10/2010 Baros et al.
7,905,156 B2 3/2011 Scott et al.
7,958,837 B1 6/2011 Fraleigh
7,975,638 B1 7/2011 Harris et al.
8,007,330 B2 8/2011 Wong et al.
8,025,006 B2 9/2011 Baros
8,028,510 B2 10/2011 Scott et al.
8,042,480 B2 10/2011 Simons
8,062,010 B2 11/2011 Paramonoff et al.
D654,880 S 2/2012 Tam
8,113,892 B1 2/2012 Gable et al.
8,141,789 B2 3/2012 Schwartzman et al.
8,145,371 B2 3/2012 Rae et al.
8,151,723 B2 4/2012 Winiski et al.
8,170,734 B2 5/2012 Kaji
8,182,396 B2 5/2012 Martin et al.
8,261,682 B1 9/2012 DeVito
8,264,338 B2 9/2012 Leon
8,347,859 B2 1/2013 Garon et al.
8,387,589 B2 3/2013 Wong et al.
8,406,944 B2 3/2013 Garon et al.
8,425,270 B2 4/2013 Dudra et al.
8,430,702 B2 4/2013 Davidson et al.
8,435,088 B2 5/2013 Morettin et al.
8,457,820 B1 6/2013 Gonring
8,516,916 B2 8/2013 Scott et al.
8,550,023 B1 10/2013 Quail
8,578,838 B2 11/2013 Davidson
8,578,873 B2 11/2013 Gasper et al.
8,583,300 B2 11/2013 Oehlgrien et al.
8,610,013 B2 12/2013 Schmidt et al.
8,612,072 B2 12/2013 Garon et al.
D698,304 S 1/2014 Dubois et al.
D698,357 S 1/2014 Mainville et al.
8,626,962 B2 1/2014 Wong et al.
8,631,753 B2 1/2014 Morvillo
8,672,086 B2 3/2014 Wong et al.
8,683,300 B2 3/2014 Stek et al.
8,751,015 B2 6/2014 Frewin et al.
8,769,944 B2 7/2014 Redfern
8,845,490 B2 9/2014 Chan et al.
D720,305 S 12/2014 Wenji
8,901,443 B2 12/2014 Baker et al.
8,930,050 B2 1/2015 Garon et al.
8,931,707 B2 1/2015 Wilnechenko et al.
8,957,338 B2 2/2015 Li
D725,050 S 3/2015 Tsugawa et al.
D725,612 S 3/2015 Schlegel et al.
8,992,273 B2 3/2015 Winiski et al.
D727,190 S 4/2015 Higgs
8,997,628 B2 4/2015 Sall et al.
9,032,898 B2 5/2015 Widmark
9,068,855 B1 6/2015 Guglielmo
9,104,227 B2 8/2015 Clarke et al.
9,233,740 B2 1/2016 Morvillo
9,260,161 B2 2/2016 Gasper et al.
9,278,740 B1 3/2016 Andrasko et al.
9,334,022 B2 5/2016 Gasper et al.
9,340,257 B2 5/2016 Ulgen
D758,325 S 6/2016 Cook et al.
D758,975 S 6/2016 Hunter et al.
9,377,780 B1 6/2016 Arbuckle et al.
9,423,894 B2 8/2016 Olsson et al.
9,459,787 B2 10/2016 Kulczycki et al.
9,522,723 B1 12/2016 Andrasko et al.
9,559,649 B2 1/2017 Noh et al.
D782,987 S 4/2017 Gassner
9,631,753 B2 4/2017 Wood et al.
9,689,395 B2 6/2017 Hartman
9,710,077 B2 7/2017 Okazaki
9,745,020 B2 8/2017 Snow
9,834,293 B2 12/2017 Wood et al.
D807,309 S 1/2018 Johnson et al.
9,857,794 B1 1/2018 Jarrell et al.
9,896,173 B2 2/2018 Baros et al.
9,911,556 B2 3/2018 Lee et al.
9,944,377 B2 4/2018 Davidson et al.
9,950,771 B1 4/2018 Hartman et al.
D818,973 S 5/2018 Tang et al.
9,978,540 B2 5/2018 Tanaka et al.
9,988,126 B2 6/2018 Wood
9,994,291 B2 6/2018 Scott
10,000,268 B1 6/2018 Poirier et al.
10,040,522 B1 8/2018 Hartman et al.
10,112,692 B1 10/2018 Anschuetz
10,202,179 B2 2/2019 Wong et al.
10,281,928 B2 5/2019 Behling et al.
10,358,189 B2 7/2019 Sheedy et al.
10,370,070 B2 8/2019 Fetchko et al.
10,386,834 B2 8/2019 Green et al.
D858,465 S 9/2019 Desbiens
10,431,099 B2 10/2019 Stewart et al.
10,457,371 B2 10/2019 Hara et al.
D884,856 S 5/2020 Jones et al.
10,647,399 B2 5/2020 Davidson et al.
10,671,073 B2 6/2020 Arbuckle et al.
10,683,073 B2 6/2020 Redfern et al.
10,683,074 B2 6/2020 Davidson et al.
10,696,368 B2 6/2020 Mizutani et al.
10,696,369 B2 6/2020 Takase et al.
10,717,503 B2 * 7/2020 Sampson ..... B63H 21/21
10,766,590 B2 9/2020 Nanjo et al.
10,781,947 B2 9/2020 Fetchko et al.
10,829,191 B2 11/2020 Wong et al.
10,889,358 B2 1/2021 Wong et al.
10,906,623 B2 2/2021 Chan et al.
10,940,927 B2 3/2021 Chan et al.
11,000,268 B2 5/2021 Poucher et al.
11,040,757 B2 6/2021 Huyge et al.
11,155,322 B2 10/2021 Baros
11,319,916 B2 5/2022 Strang et al.
11,433,981 B2 9/2022 Chan et al.
11,465,726 B2 10/2022 Nakatani
11,467,583 B2 10/2022 Mizutani
11,530,022 B1 12/2022 Andrasko et al.
11,679,853 B2 6/2023 Wong et al.
2003/0082964 A1 5/2003 Simner
2005/0233655 A1 10/2005 Maselter

(56) References Cited

U.S. PATENT DOCUMENTS

| | | | |
|---|---|---|---|
| 2007/0006101 | A1 | 1/2007 | Michaels |
| 2007/0238370 | A1 | 10/2007 | Morvillo |
| 2007/0276563 | A1 | 11/2007 | Kaji |
| 2009/0076671 | A1 | 3/2009 | Mizutani |
| 2009/0165694 | A1 | 7/2009 | Beamer |
| 2010/0094491 | A1 | 4/2010 | Oehlgrien et al. |
| 2010/0102173 | A1 | 4/2010 | Everett et al. |
| 2010/0198435 | A1 | 8/2010 | Cansiani et al. |
| 2011/0000268 | A1 | 1/2011 | Schaafsma et al. |
| 2011/0120364 | A1 | 5/2011 | Mueller |
| 2011/0143608 | A1 | 6/2011 | Chiecchi |
| 2011/0151732 | A1 | 6/2011 | Chiecchi |
| 2011/0320072 | A1 | 12/2011 | Morvillo |
| 2012/0103774 | A1 | 5/2012 | Jun |
| 2012/0247934 | A1 | 10/2012 | Schmidt et al. |
| 2013/0213293 | A1 | 8/2013 | Gasper et al. |
| 2014/0043303 | A1 | 2/2014 | Baker et al. |
| 2014/0183011 | A1 | 7/2014 | Park et al. |
| 2014/0224166 | A1 | 8/2014 | Morvillo |
| 2014/0348207 | A1 | 11/2014 | Wilnechenko et al. |
| 2014/0365050 | A1 | 12/2014 | Morvillo |
| 2016/0097393 | A1 | 4/2016 | Hartman |
| 2017/0250037 | A1 | 8/2017 | Tanaka et al. |
| 2017/0313386 | A1 | 11/2017 | Snow |
| 2017/0349257 | A1 | 12/2017 | Hara et al. |
| 2018/0201342 | A1 | 7/2018 | Huyge et al. |
| 2020/0303235 | A1 | 9/2020 | Miyadate et al. |
| 2020/0354030 | A1 | 11/2020 | Bowie |
| 2021/0107617 | A1 | 4/2021 | Nakatani |
| 2022/0004125 | A1 | 1/2022 | Mitsumata et al. |
| 2022/0334596 | A1 | 10/2022 | Chan et al. |
| 2022/0355913 | A1 | 11/2022 | Davidson et al. |
| 2023/0041461 | A1* | 2/2023 | Gallagher ..... B63B 39/06 |
| 2023/0073225 | A1 | 3/2023 | Chan et al. |
| 2023/0166823 | A1 | 6/2023 | Wood et al. |
| 2023/0257096 | A1 | 8/2023 | Wong et al. |
| 2023/0303235 | A1 | 9/2023 | Wong et al. |

FOREIGN PATENT DOCUMENTS

| | | | |
|---|---|---|---|
| CA | 2795437 | | 4/1928 |
| CA | 304073 | A | 9/1930 |
| CA | 892350 | A | 2/1972 |
| CA | 2236483 | C | 5/1998 |
| CA | 2372402 | C | 2/2002 |
| CA | 3048271 | A1 | 6/2019 |
| CA | 3048276 | A1 | 6/2019 |
| CA | 3048282 | A1 | 12/2020 |
| CN | 109110073 | A | 1/2019 |
| CN | 112124548 | A | 12/2020 |
| DE | 19837888 | C1 | 8/1998 |
| EP | 0928739 | A2 | 7/1999 |
| JP | H0350087 | A | 3/1991 |
| JP | H0382697 | A | 4/1991 |
| JP | H03114996 | A | 5/1991 |
| JP | H06255577 | A | 9/1994 |
| JP | H09286390 | A | 11/1997 |
| JP | H09315384 | A | 12/1997 |
| JP | 2001294197 | A | 10/2001 |
| JP | 2002-284087 | A | 10/2002 |
| JP | 2003341589 | A | 12/2003 |
| JP | 2004224103 | A | 8/2004 |
| JP | 2005-280550 | A | 10/2005 |
| JP | 2005324716 | A | 11/2005 |
| JP | 2009037287 | A | 4/2009 |
| JP | 2012-035786 | A | 2/2012 |
| JP | 2013035351 | A | 2/2013 |
| JP | 2013100102 | A | 5/2013 |
| JP | 2014196091 | A | 10/2014 |
| JP | 2018030573 | A | 3/2018 |
| KR | 10-2011-0078767 | A | 7/2011 |
| KR | 10-2011-0139800 | A | 12/2011 |
| KR | 10-2012-0019280 | A | 3/2012 |
| KR | 10-1259134 | B1 | 4/2013 |
| KR | 10-1297596 | B1 | 8/2013 |
| KR | 10-2013-0119071 | A | 10/2013 |
| KR | 10-1491661 | B1 | 2/2015 |
| KR | 10-2017-0143039 | A | 12/2017 |
| KR | 10-2275079 | B1 | 7/2021 |
| WO | 2003068590 | A2 | 8/2003 |
| WO | 2006058232 | A1 | 6/2006 |
| WO | 2008100903 | A2 | 8/2008 |
| WO | 2009134153 | A1 | 5/2009 |
| WO | 2010003905 | A1 | 1/2010 |
| WO | 2011099931 | A1 | 8/2011 |
| WO | 2011142870 | A2 | 11/2011 |
| WO | 2016036616 | A1 | 3/2016 |
| WO | 2016209401 | A1 | 12/2016 |
| WO | 2023092228 | A1 | 1/2023 |

OTHER PUBLICATIONS

Volvo Penta; Boat Trim System; Mar. 2017; 4 pgs.

Australian Boat Magazine; The Intriguing Zipwake Trim; May 2015; 6 pgs.

Interceptors/Trim Tabs/Force Producers for Ship Motion Control—Maritime Dynamics, Inc.

International Search Report and Written Opinion, filed in PCT/US2022/038962 dated Nov. 16, 2022; 7 pgs.

International Search Report and Written Opinion, filed in PCT/US2022/038102 dated Nov. 15, 2022; 9 pgs.

International Search Report and Written Opinion, filed in PCT/US2022/038964 dated Nov. 28, 2022; 8 pgs.

International Search Report and Written Opinion, filed in PCT/US2022/040944 dated Dec. 2, 2022; 7 pgs.

AutoTrimPro Electric Owner Install Guide; 48 pgs.

Trygve Lauvdal and Thor I. Fossen; Norwegian University of Science and Technology, Department of Engineering Cybernetics, n-7034 Trondheim, Norway; Nonlinear Non-Minimum Phase Rudder-Roll Damping System for Ships Using Sliding Mode Control; 6 pgs.

Asgei J. Sorenson; Department of Marine Technology, Norwegian University of Science and Technology ; 2013 Department of Marine Technology, NTNU; Marine Control Systems, Propolsion and Motion Control of Ships and Ocean Sructures Lecture Notes; 536 pgs.

European Patent Office Extended European Search Report mailed Aug. 26, 2022 from corresponding European Patent Application No. 19869718.7; 7 pages.

WIPO, Canadian International Searching Authority, International Search Report mailed Dec. 13, 2019 in corresponding International Patent Application No. PCT/CA2019/051410, 3 pages.

WIPO, Canadian International Searching Authority, Written Opinion mailed Dec. 4, 2019 in corresponding International Patent Application No. PCT/CA2019/051410, 6 pages.

LENCO—We Make the Best Boats Better!; The World Leader in Trim Tab Systems & Hatch Lift Innovation Owner's Manual; May 21, 2019; 28 pgs.

Examination Report issued Apr. 1, 2025 in Application No. GB2402374.9; 5 pgs.

* cited by examiner

MOUNTING PLATE ASSEMBLY AND SYSTEM

CROSS-REFERENCE TO RELATED APPLICATION

This application claims the benefit of and priority to U.S. Provisional Application No. 63/235,988, filed Aug. 23, 2021, the content of which is hereby incorporated by reference.

FIELD OF THE DISCLOSURE

The present disclosure generally relates to an improved mounting assembly and system for mounting a device to a bulkhead, and specifically relates to a mounting plate assembly and system for mounting a water engagement device to a transom of a stern on a marine vessel, watercraft or boat.

BACKGROUND

In the marine industry, it is commonly understood that mechanical devices may be used to generate a variable lifting force in a marine vessel, as desired. The variable lifting force may be generated by deploying a device into the water flow under a transom of the marine vessel when the vessel is underway or by changing the angle of attack of the device relative to the water flow during operation of a marine vessel. A non-exhaustive list of commonly available and conventionally used devices includes trim tabs, fins, wake gates, interceptors, and other devices that that engage the water in similar manner and/or provide similar functionality. Each of these devices also includes an actuator that enables the deployment, angle of attack change or retraction of the device. The actuator may be electric, hydraulic or other technology to provide the same functionality. In this disclosure such devices and their associated actuators and other components are collectively referred to as water engagement devices.

Conventional techniques for mounting the water engagement devices to the transom or near the transom of the watercraft are usually a pivotal or linear sliding arrangement, but each is disadvantageous because of a large number of transom or hull penetrations and a lack of modularity or adjustability.

The pivotal arrangement includes a mounting flange through which fasteners secure the flange to the transom. The fasteners may extend into or through the transom. Commonly, a through fastener is used but, due to the construction of the watercraft, a reinforcing member or stringer is disposed in the same location making secure fitment impossible or requiring re-installation of the water engagement device in a different location, possibly less desirable. Fasteners that extend into the transom do not pass through the transom. In order to facilitate the pivotal movement of the water engagement devices the actuator is mounted to or near the transom or inside the watercraft via a pass-through opening.

The linear sliding arrangement is limited to interceptor water engagement devices and usually includes a housing fixed to the transom by through fasteners that includes the water engagement device and in some cases the actuator. Other examples dispose the actuator inside the vessel with a operative link connected to the water engagement device via a pass-through opening.

Therefore, there exists a need for an assembly and system that mounts a water engagement device to or near the transom of a marine vessel and does not require fasteners, either into or through, to secure the water engagement device to or near the transom and is modular and adjustable to accommodate a wide variety of marine vessel transom configurations.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION OF THE DISCLOSURE

Figure 1:
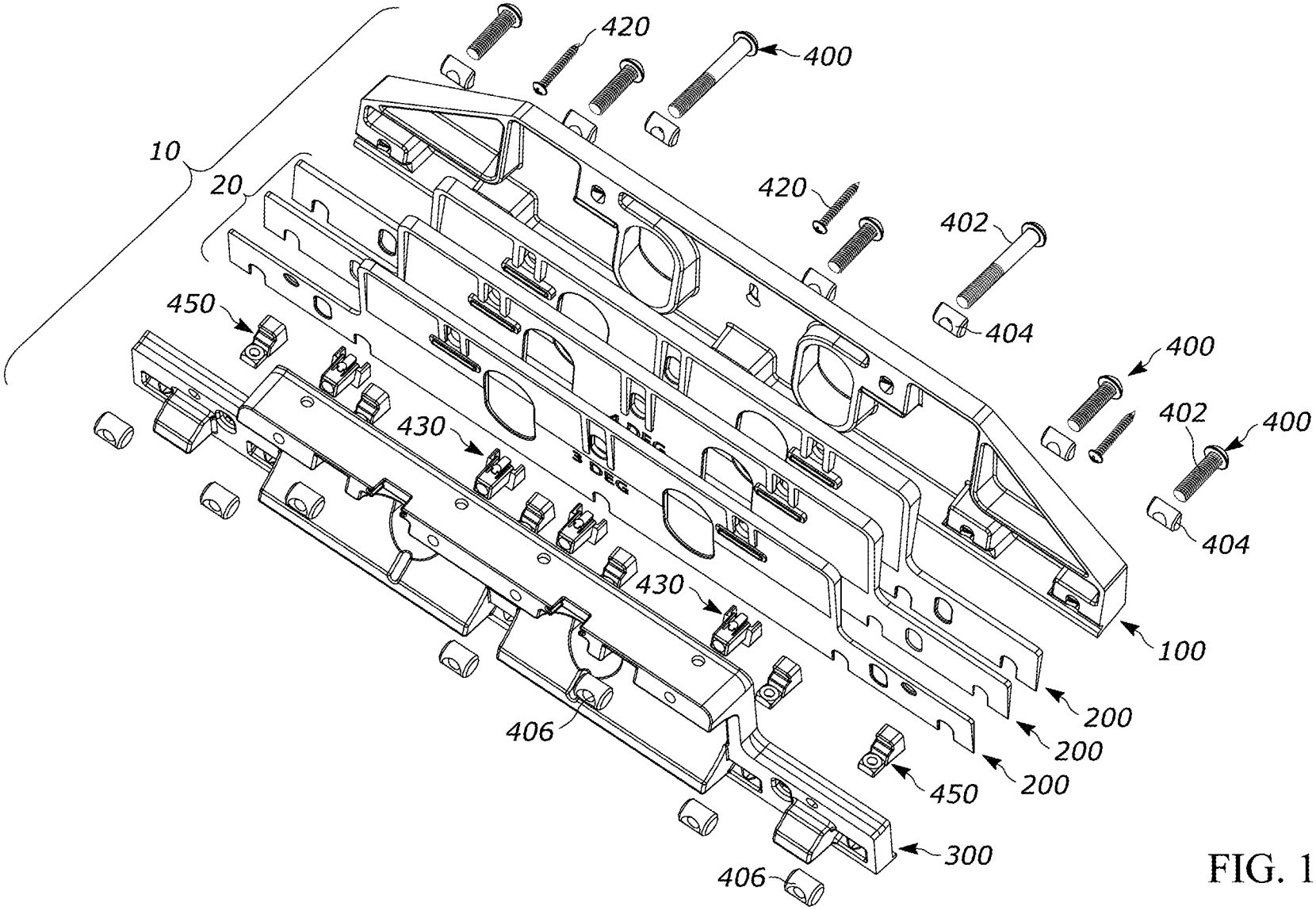
FIG. 1 is an exploded perspective view of a mounting plate assembly and system of the present disclosure.

For the purposes of promoting and understanding the principles disclosed herein, reference is now made to the embodiments, including preferred embodiments, illustrated in the drawings, and specific language is used to describe the same.

In one aspect of the present disclosure, an assembly may be adapted for mounting a water engagement device to a marine vessel may include a transom plate, an actuator plate and a clamping assembly. The transom plate may have a front surface that is adapted to be connected to the marine vessel and a bottom side. The actuator plate may have a front surface and a flange extending from the front surface, wherein the flange is disposed under the bottom side of the transom plate. The clamping assembly may be configured to engage the transom plate and the actuator plate to connect the actuator plate to the transom plate.

In another aspect of the present disclosure, the actuator plate may have a front surface and a bottom side that extends beyond the front surface to define a flange, wherein the bottom side of the transom plate is disposed above the flange.

In another aspect of the present disclosure, a wedge pack including at least one shim may be disposed between the transom plate and the actuator plate.

In another aspect of the present disclosure, the actuator plate may include an upper coupling pocket configured to be disposed therein an upper nut retainer and a nut, where the nut oriented to receive a fastener through the back surface.

In another aspect of the present disclosure, the upper nut retainer may include an opening that is registered in alignment with the nut opening.

In another aspect of the present disclosure, the actuator plate may include a lower coupling pocket configured to be disposed therein a lower nut retainer and a nut, where the nut is oriented to receive a fastener through the bottom side.

In another aspect of the present disclosure, the upper nut retainer and the lower nut retainer may be cantilever snap-fit into the respective coupling pocket.

In another aspect of the present disclosure, a marine vessel may include a transom, a transom plate connected to the transom, an actuator plate having a ledge, where a bottom side of the transom plate disposed adjacent a rear surface of the transom plate is disposed above the ledge, a wedge pack including at least one shim disposed between the transom plate and the actuator plate, and a clamping assembly that, when tightened, forces the actuator plate and wedge pack against the transom plate.

In another aspect of the present disclosure, the transom plate may include a projection disposed on and extending from the front surface into contact with the transom.

In another aspect of the present disclosure, a positioning fastener may be connected to the transom and disposed in a positioning opening formed in the transom plate.

In another aspect of the present disclosure, a method of installing an assembly adapted for mounting a water engagement device to a transom of a marine vessel may include the steps of: measuring an angle of the transom with respect to a bottom surface of the marine vessel; selecting a shim for a wedge pack based on the angle of the transom; installing a positioning fastener into engagement with the transom; compressing the assembly including the wedge pack disposed between the transom plate and an actuator plate with a clamping assembly; aligning a positioning opening formed in the transom plate with the positioning fastener; and affixing adhesively the assembly to the transom.

Accordingly, it is an object of the disclosure to not encompass within the disclosure any previously known product, process of making the product, method of using the product, or method of treatment such that Applicants reserve the right and hereby disclose a disclaimer of any previously known product, process, or method. It is further noted that the disclosure does not intend to encompass within the scope of the disclosure any product, process, or making of the product or method of using the product, which does not meet the written description and enablement requirements of the USPTO (35 U.S.C. § 112, first paragraph) or the EPO (Article 83 of the EPC), such that Applicants reserve the right and hereby disclose a disclaimer of any previously described product, process of making the product, or method of using the product.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. Patent law, e.g., they allow for elements not explicitly recited, but exclude elements that are found in the prior art or that affect a basic or novel characteristic of the disclosure.

These and other embodiments are disclosed or are obvious from and encompassed by the following Detailed Description.

FIG. 1 is an exploded perspective view of a mounting plate assembly and system 10 of the present disclosure. The mounting plate assembly or system 10 may primarily comprise a transom plate 100 and an actuator plate 300. Additionally, a wedge pack 20 may be included. The wedge pack 20 may include a shim 200 or a plurality of shims 200 based on an angle 604 of a transom 602 of a marine vessel 600. A clamping assembly 400 may be used to compress the assembly 10 prior to installation. The clamping assembly 400 may include at least a threaded fastener 402, a washer 404 and a nut 406. In one embodiment, the washer 404 has semi-cylindrical configuration and the nut 406 has a cylindrical configuration. Such component configurations facilitate the use of a straight threaded fastener 402 so that an even application of compressive clamping loads may applied to the transom and actuator plates 100, 300 (as well as the wedge pack 20, if used) over a wide range of angles without different transom or actuator plates 100, 300. Upper nut retainers 430 and lower nut retainers 450 may be operatively connected to the actuator plate 300 in order to facilitate connection of a water engagement device to the actuator plate 300. Positioning fasteners 420 may engage a transom 602 of a marine vessel 600 to facilitate installation of the assembly or system 10.

Figure 2:
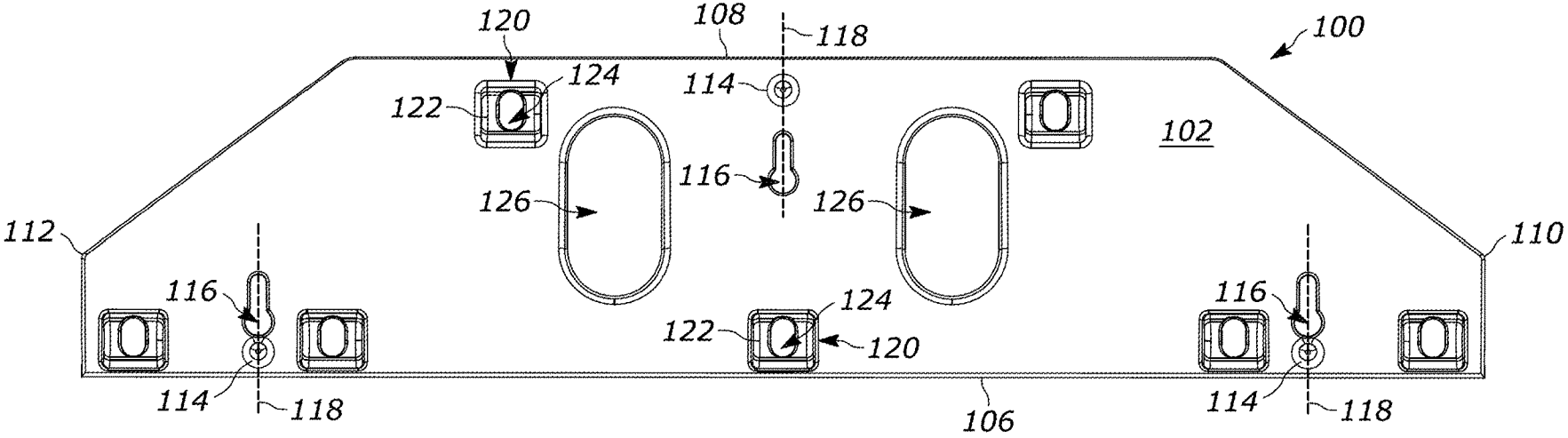
FIG. 2 is a front elevation view of a transom plate of the mounting plate assembly and system of FIG. 1.
Figure 3:
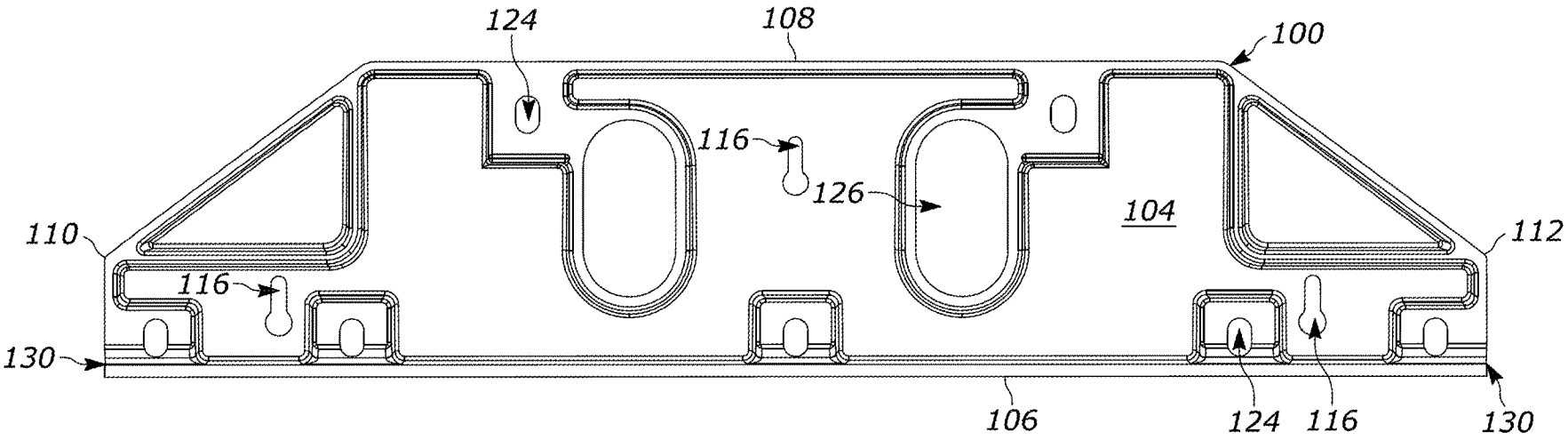
FIG. 3 is a rear elevation view of the transom plate of FIG. 2.

FIG. 2 is a front elevation view and FIG. 3 is a rear elevation view of a transom plate 100 of the mounting plate assembly and system 10 of FIG. 1. The transom plate 100 may include a front surface 102, a rear surface 104, a bottom side 106, a top side 108 and a pair of opposing ends 110, 112. A routing opening 126 may be defined or formed in the transom plate 100 to facilitate connection of the water engagement device (not shown) to power and communications signal connections on the boat 600. A projection 114 may be disposed on an extending from the front surface 102. In one embodiment, three projections 114 may be formed in order to define a plane when disposed in engagement with the transom 602 of the marine vessel 600 to facilitate a generally even adhesive 500 thickness between the transom 602 and the transom plate 100 and also so that the transom plate 100 is not distorted when connected to the transom 602 to cause misalignment or connection issues with the other components of the assembly 10. One of skill in the art will recognize that the transom 602 of a watercraft 600 usually has some imperfections and is not as flat or smooth as the transom plate 100 due to the materials of construction of the watercraft 600. In another embodiment, projections 114 may be disposed near opposed ends 110, 112 along the bottom side 106 and near the center of the top side 108.

A positioning opening 116 may be defined or formed in the transom plate 100. In one embodiment, a positioning opening 116 may be disposed adjacent to each projection 114. In another embodiment, a positioning opening 116 may have a center line 118 where a projection 114 is bisected by the center line 118. In another embodiment, each of the three projections 114 is disposed in vertical alignment with the center line 118 of the positioning opening 116.

A clamping pocket 120 may be defined or formed in the front surface 102 of the transom plate 100. The clamping pocket 120 may include a contoured surface 122 that is recessed from the front surface 102 and a clamping opening 124 that extends through the transom plate 100. In one embodiment, the contoured surface 122 is configured to be complementarily shaped to the washer 404 so as to enable the washer 404 to have multiple orientations to facilitate even compressive clamping of the transom plate 100 and actuator plate 300 over a wide range of angles. In another embodiment, the contoured surface 122 has a semi-cylindrical configuration that complementarily engages the semi-cylindrical washer 404. In another embodiment, the clamping opening 124 has an oblong configuration to facilitate, without binding or limitation of movement of the threaded fastener 402, the even compressive clamping of the transom plate 100 and actuator plate 300 over a wide range of angles.

Figure 4:
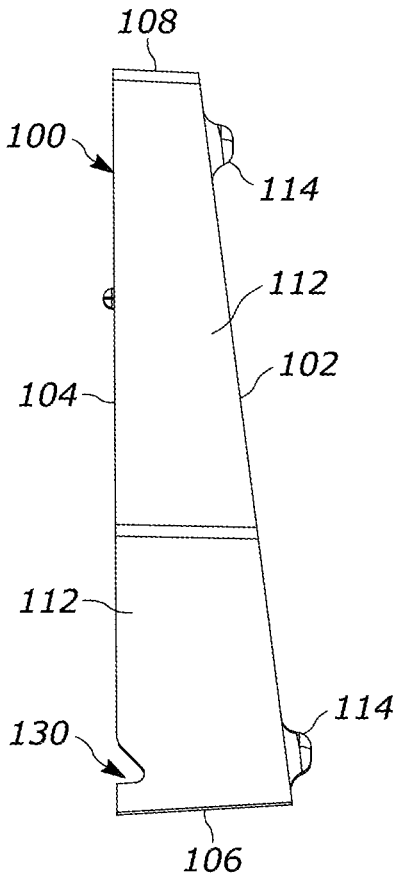
FIG. 4 is an end elevation view of the transom plate of FIG. 2.

FIG. 4 is an end elevation view of the transom plate of FIG. 2. A groove 130 may be defined or formed in the rear surface 104 adjacent the bottom side 106 to facilitate the potential use of a plurality of shims 200 (regardless of the number) in the wedge pack 20 so as to avoid binding between the transom plate 100, shims 200 and the actuator plate 300. In one embodiment, the groove 130 extends across the front surface 102 from end 110 to end 112, see FIG. 2.

Figure 5:
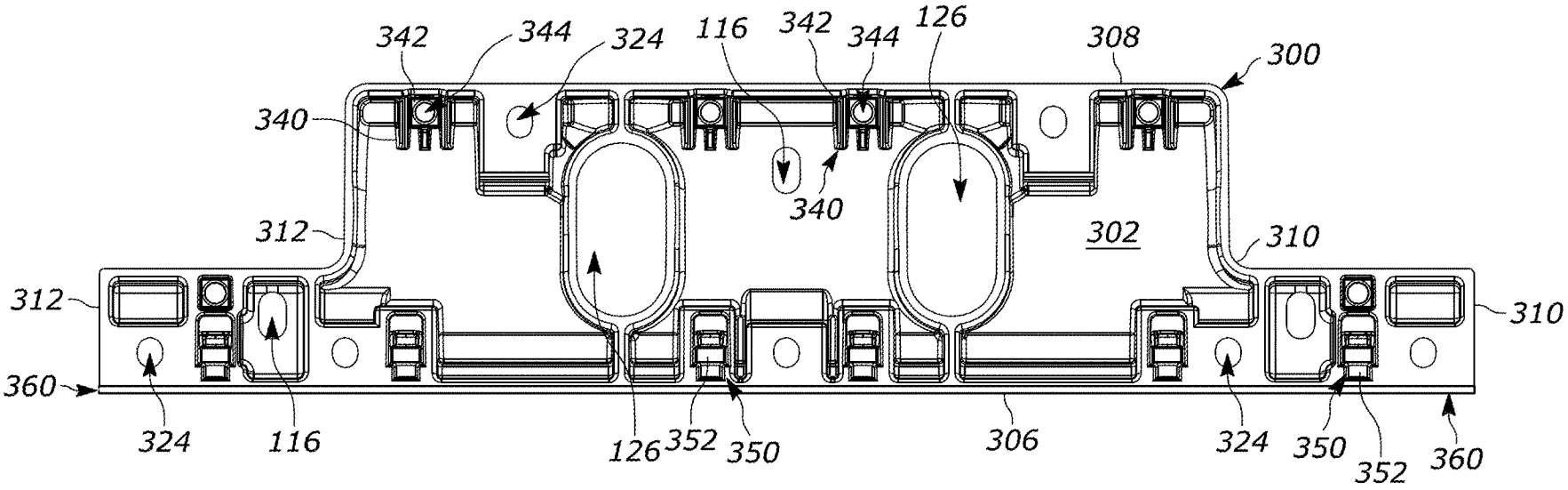
FIG. 5 is a front elevation view of an actuator plate of the mounting plate assembly and system of FIG. 1.
Figure 6:
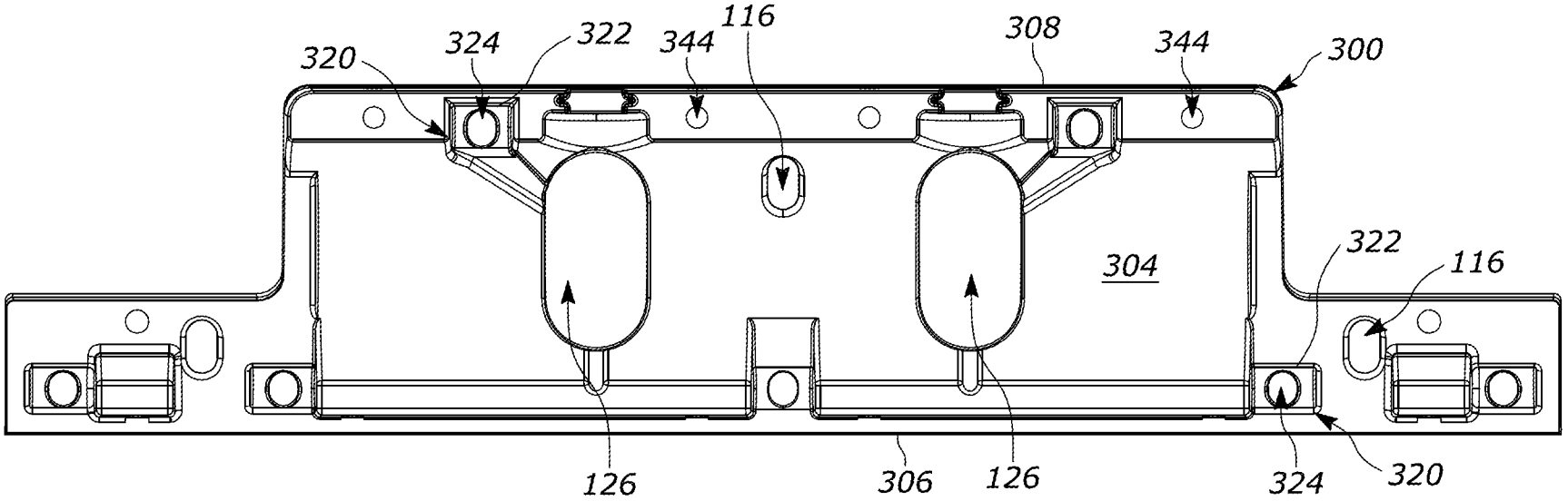
FIG. 6 is a rear elevation view of the actuator plate of FIG. 5.
Figure 7:
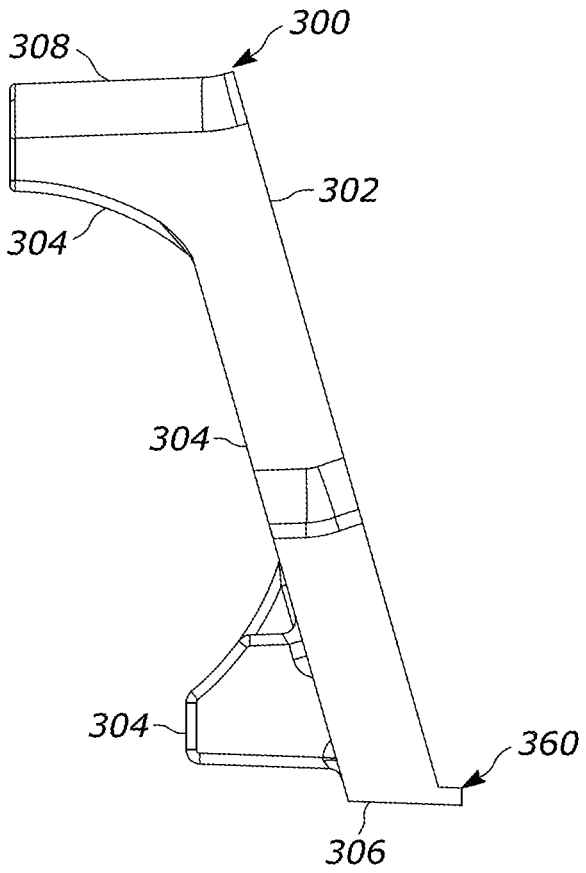
FIG. 7 is an end elevation of the actuator plate of FIG. 5.

FIG. 5 is a front elevation view, FIG. 6 is a rear elevation view and FIG. 7 is an end elevation view of an actuator plate 300 of the mounting plate assembly or system 10 of FIG. 1. The actuator plate 300 may include a front surface 302, a rear surface 304, a bottom side 306, a top side 308, and a pair of opposing ends 310, 312. A positioning opening 116 may be defined or formed in the actuator plate 300 aligned in registration with a similar opening in the transom plate 100 to facilitate installation of the assembly 10. A routing opening 126 may be defined or formed in the actuator plate 300 aligned in registration with a similar opening in the transom plate 100 to facilitate connection of the water engagement device (not shown) to power and communications signal connections on the boat 600.

An upper coupling pocket 340 may be defined or formed in the front surface 302 of the actuator plate 300. The upper coupling pocket 340 may be disposed adjacent the top side 308 and may include a contoured surface 342 that is recessed from the front surface 302 and an upper coupling opening 344 that extends through the actuator plate 300. In one embodiment, the contoured surface 342 is configured to be complementarily shaped to dispose therein the upper nut retainer 430 and a nut 432. In another embodiment, the upper coupling opening 344 extends through the back surface 302 of the actuator plate 300. In another embodiment, the upper coupling opening 344 may be aligned in registration with an opening 433 in the nut 432 so that the upper coupling opening 344 and the nut opening 433 are adapted to receive a threaded fastener 434 therethrough. The threaded fastener 434 may be useful to facilitate connection of the water engagement device to the actuator plate 300, directly or indirectly. Since the nut 432 is installed into the upper coupling pocket 340 prior to the upper nut retainer 430 being connected to the actuator plate 300, the nut 432 will remain properly positioned to facilitate engagement by the threaded fastener 434 without any contact with the nut. In another embodiment, the upper nut retainer 430 may include a back surface 436 including an opening 438 defined or formed therein aligned in registration with the nut opening 433. In one embodiment, the nut retainer 430 is connected to the upper coupling pocket 340. In another embodiment, the nut retainer 430 is cantilever snap-fit into the upper coupling pocket 340 via an arm 440 having a catch 442 that causes the arm 440 to deflect during insertion into the upper coupling pocket 430 until the catch 442 is disposed in an opening 444 in the top side 308 of the actuator plate.

A lower coupling pocket 350 may be defined or formed in the front surface 302 of the actuator plate 300. The lower coupling pocket 350 may be disposed adjacent the bottom side 306 and may include a contoured surface 352 that is recessed from the front surface 302 and a lower coupling opening 354 that extends through the actuator plate 300. In one embodiment, the contoured surface 352 is configured to be complementarily shaped to dispose therein the lower nut retainer 450 and a nut 452. In another embodiment, the lower coupling opening 354 extends through the bottom side 306 of the actuator plate 300. In another embodiment, the lower coupling opening 354 may be aligned in registration with an opening 453 in the nut 452 so that the lower coupling opening 354 and the nut opening 453 are adapted to receive a threaded fastener 454 therethrough. The threaded fastener 454 may be useful to facilitate connection of the water engagement device to the actuator plate 300, directly or indirectly. Since the nut 452 is installed into the lower coupling pocket 350 prior to the lower nut retainer 450 being connected to the actuator plate 300, the nut 452 will remain properly positioned to facilitate engagement by the threaded fastener 454 without any contact with the nut. In another embodiment, the lower nut retainer 450 is cantilever snap-fit into the lower coupling pocket 350 via an arm 456 having a catch 457 that causes the arm 456 to deflect during insertion into the lower coupling pocket 350 until the catch 457 is disposed in an opening 458 in the bottom side 306 of the actuator plate 300.

A flange 360 may be defined by the bottom side 306 extending beyond the front surface 302 or formed by extending from the front surface 302. In one embodiment, the flange 360 is disposed under the bottom side 106 of the transom plate 100 when the assembly 10 is compressed by the clamping assembly 400. In another embodiment, the bottom side 306 of the transom plate 100 is disposed above the flange 360 when the assembly 10 is compressed by the clamping assembly 400.

A clamping pocket 320 may be defined or formed in the rear surface 302 of the actuator plate 300. The clamping pocket 320 may include a contoured surface 322 that is recessed from the rear surface 302 and a clamping opening 324 that extends through the actuator plate 300. In one embodiment, the contoured surface 322 is configured to be complementarily shaped to the nut 406 so as to enable the nut 406 to have multiple orientations to facilitate even compressive clamping of the transom plate 100 and actuator plate 300 over a wide range of angles. In another embodiment, the contoured surface 322 has a semi-cylindrical configuration that complementarily engages the cylindrical nut 406. In another embodiment, the clamping opening 324 has an oblong configuration to facilitate, without binding or limitation of movement of the threaded fastener 402, the even compressive clamping of the transom plate 100 and actuator plate 300 over a wide range of angles.

Figure 8:
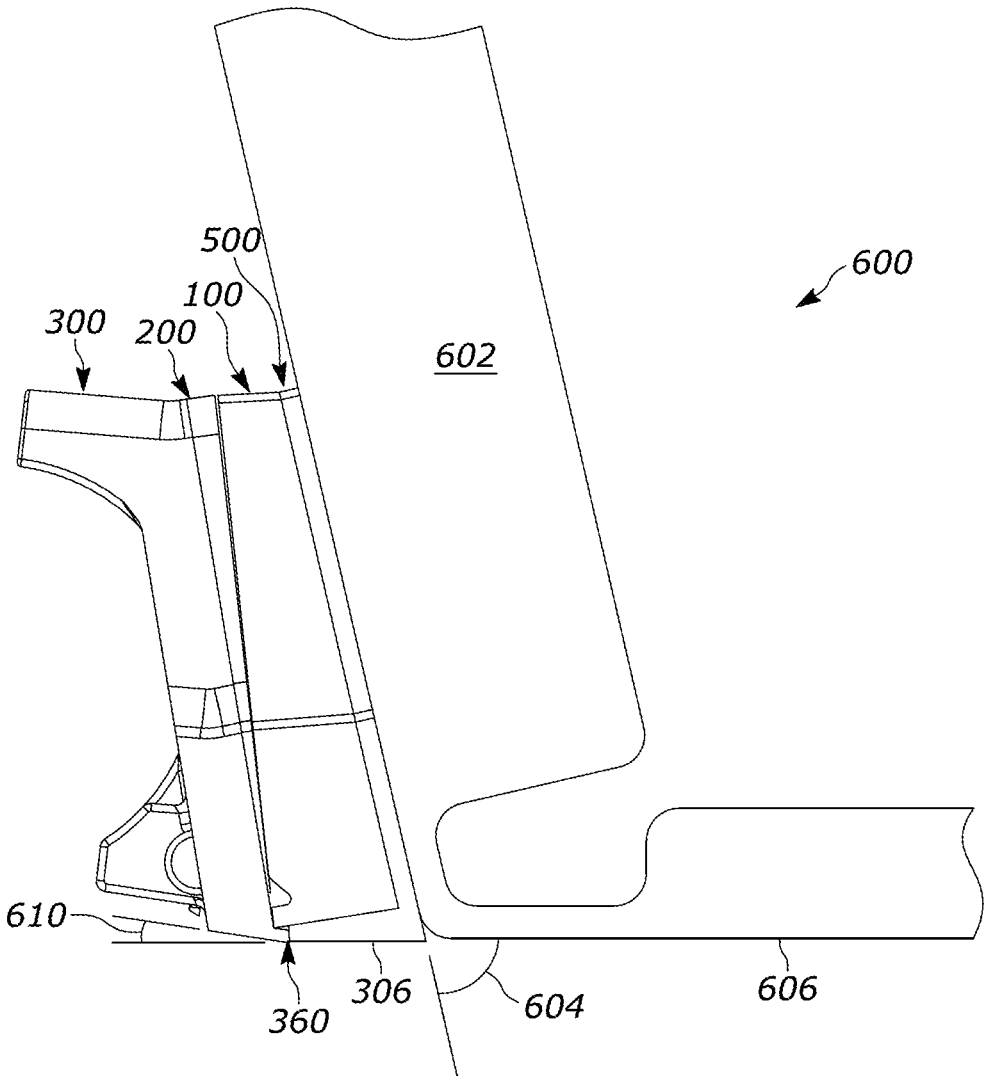
FIG. 8 is an assembly view of the mounting plate assembly and system of FIG. 1 illustrating one embodiment of a wedge pack.

FIG. 8 is an assembly view of the mounting plate assembly and system 10 of FIG. 1 illustrating one embodiment of a wedge pack 20 with a single shim 200, but installed incorrectly. One step in the method of installing the assembly 10 (which shall be deemed to include the method of installing the assembly 10 to a wall of a pocket or recess defined or formed near the intersection of the transom 602 and a bottom surface 606 of the marine vessel 600, as commonly known, which would position the assembly 10 above the bottom surface 606 of the vessel 600 but forward of the transom 602) is measuring an angle 604 of the transom 602 relative to a bottom surface 606 of the vessel 600 adjacent the transom 602. While this angle 604 is entirely dependent on the manufacturer of the marine vessel 600, conventional designs usually have a transom angle 604 of approximately 68-83 degrees. One of skill in the art will recognize that a transom angle 604 greater or less than that range may be available. The assembly 10 can accommodate and properly mount a water engagement device on a transom 602 with any available or desirable transom angle 604 by simple measurement and calculation of the correct wedge pack to reduce the assembly angle 610 close to zero. Accordingly, another step in the installation process may include selecting at least one shim 200 for a wedge pack 20 based on the transom angle 604.

In order to properly connect the assembly 10 to the transom 602 one should use the transom plate 100 as a template to transfer the location of the positioning openings onto the transom 602 so that the positioning fasteners 420 may be disposed in engagement with the transom 602 so as to penetrate the transom 602 but stand proud sufficiently to function to facilitate the installation of the compressed assembly 10. The assembly 10 comprising the transom plate 100, wedge pack 20 (including the proper shims 200 based on the measured transom angle 604), actuator plate 300 and clamping assembly 400 may be combined into a functional integral unit. The clamping assembly 400 may be tightened by rotating the threaded fastener 402 against the fixed nut 406 to compress the assembly 10 so that the wedge pack 20 is disposed between the transom plate 100 and the actuator plate 300 to a desired force.

The installed assembly 10 in FIG. 8 includes adhesive 500 to affix the assembly to the transom 602, the transom plate 100, a single shim 200 wedge pack and an actuator plate 300. However, the assembly angle 610 is greater than zero. One result of this install is that the water engagement device will not work as designed with lower efficiency and effectiveness. Preferably, the assembly angle 610 is near zero degrees. In another embodiment, the assembly angle 610 may be in the range of approximately −1 degree to +1 degree. In another embodiment, the assembly angle 610 may be in the range of approximately −2 degrees to +2 degrees. In another embodiment, the assembly angle 610 may be in the range of approximately −3 degrees to +3 degrees. In another embodiment, the assembly angle 610 may be in the range of approximately −4 degrees to +4 degrees. In another embodiment, the assembly angle 610 may be in the range of approximately −5 degrees to +5 degrees. In another embodiment, the assembly angle 610 may be in the range of approximately −10 degrees to +10 degrees. In another embodiment, the assembly angle 610 may be in the range of approximately −15 degrees to +15 degrees. In one embodiment, the adhesive 500 is a strong glue or adhesive so that the transom plate 100 and the remainder of the connected assembly 10 remain attached to the transom permanently. In another embodiment, the adhesive 500 may be a two-part epoxy-based, methacrylate-based or acrylic-based adhesive, such as may be available from, for example only, Plexus®, Loctite®, Orenco®, Parson®, etc. In one embodiment, the adhesive 500 may be applied to the transom plate 100. In another embodiment, the adhesive 500 may be applied to the transom 602. In another embodiment, the adhesive 500 may be applied to the transom plate 100 and transom 602. Further, adhesive 500 may be applied after the assembly 10 is installed in order to provide a smooth transition for the water flow from the bottom surface 606 to the flange 360.

Figure 9:
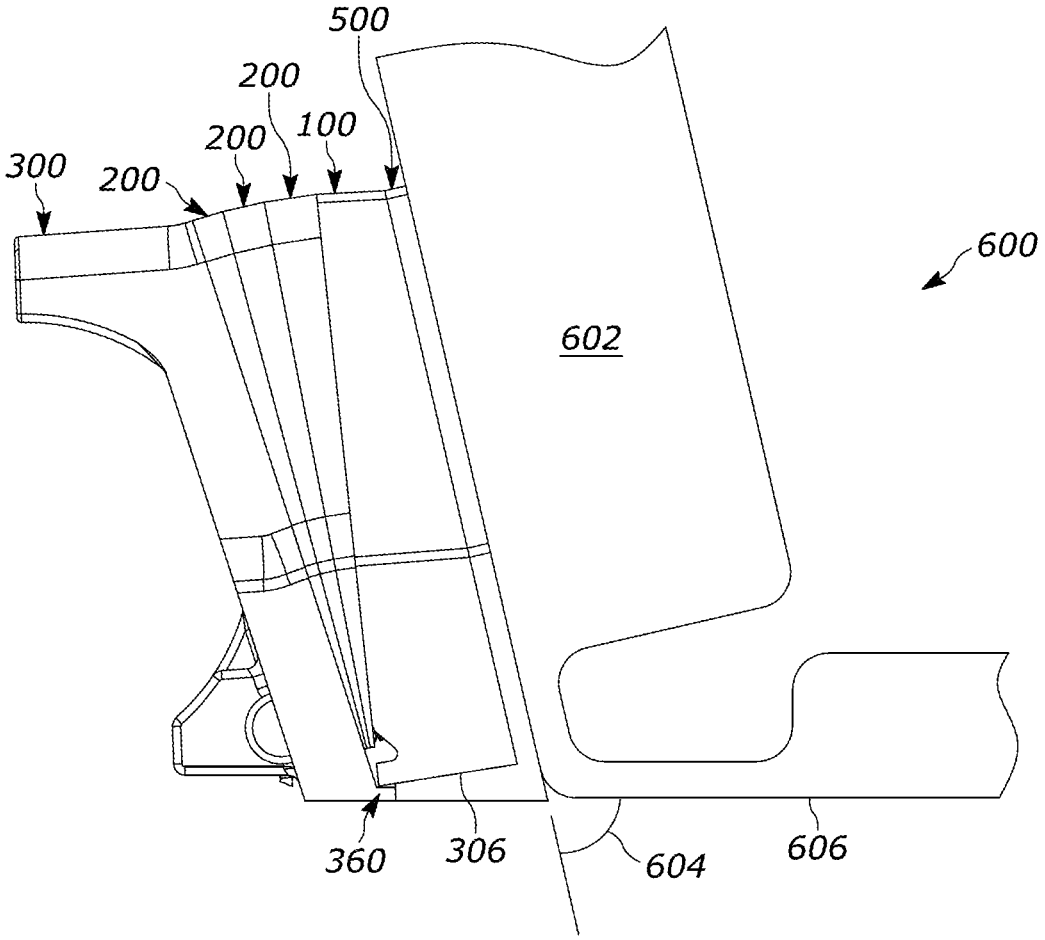
FIG. 9 is an assembly view of the mounting plate assembly and system of FIG. 1 illustrating another embodiment of the wedge pack.

FIG. 9 is an assembly view of the mounting plate assembly or system 100 of FIG. 1 illustrating another embodiment of the wedge pack 20 with a plurality of shims 200 for a correct installation. Based on the transom angle 604, three shims 200 result in a zero assembly angle 610 in this embodiment. In one embodiment, the wedge pack 20 may include shims 200 to provide an adjustment range of approximately 3 degrees to 18 degrees. In another embodiment, the wedge pack 20 may be configured to provide an adjustment range greater than 18 degrees. In another embodiment, the wedge pack 20 may be configured to provide an adjustment range less than 3 degrees. In one embodiment, each individual shim 200 may be configured to provide an adjustment range of approximately 1 degree to 10 degrees. In another embodiment, each individual shim 200 may be configured to provide an adjustment range greater than 10 degrees. In another embodiment, each individual shim 200 may be configured to provide an adjustment range less than 1 degree. When a properly configured wedge pack 20 is compressed between the transom plate 100 and the actuator plate 300 to the desired force, the assembly 10 is preferably disposed so that the positioning opening 116 is aligned with and over the positioning fastener 420 so that the assembly 10 may be moved into engagement with the transom 602 such that positioning fastener 420 extends through the positioning opening 116. The positioning fastener 420 may be tightened to fix the assembly 10 in position so that the adhesive 500 may cure. The positioning fastener 420 does not secure the assembly 10 to the transom 602.

Figure 10:
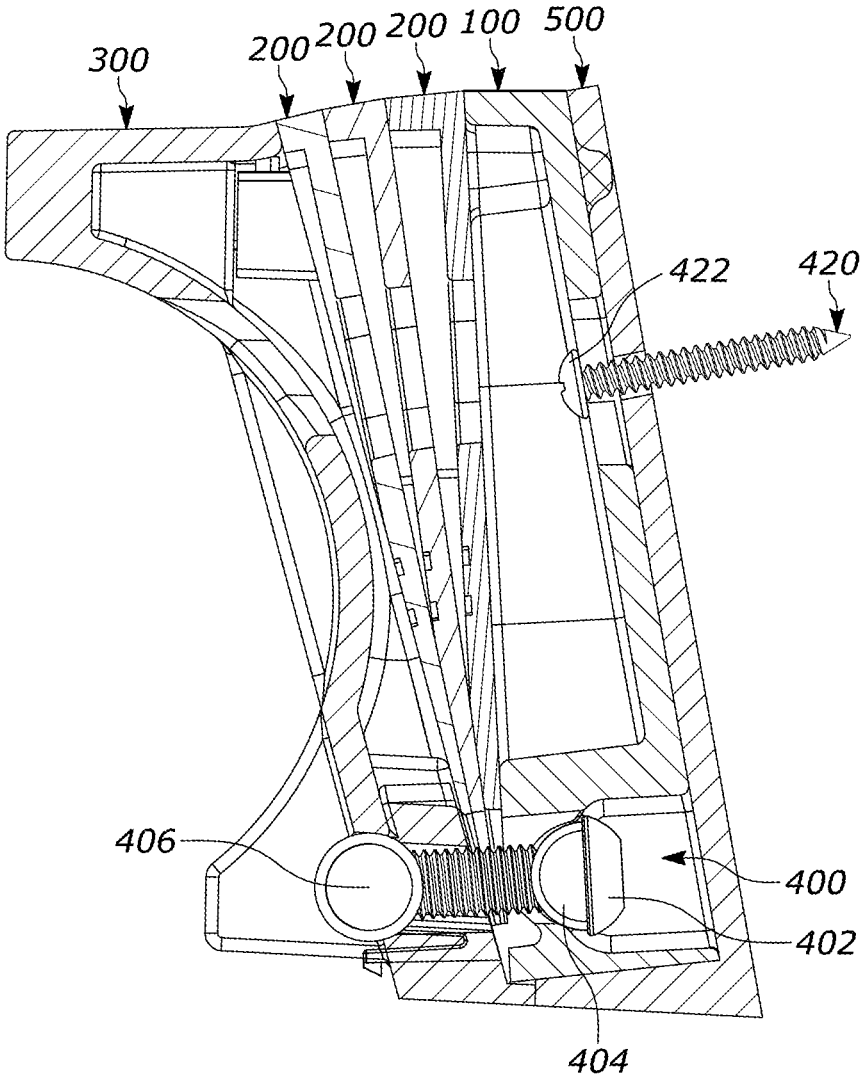
FIG. 10 is a cross section view of the assembly of the mounting plate assembly and system of FIG. 9 illustrating a positioning fastener and a lower clamping assembly.

FIG. 10 is a cross section view of the assembly of the mounting plate assembly or system 10 of FIG. 9 illustrating a positioning fastener 420 and a lower clamping assembly 400. The positioning fastener 420 may include a head 422 that is larger than a portion of the positioning opening 116 so as to bear against the transom plate 100.

Figure 11:
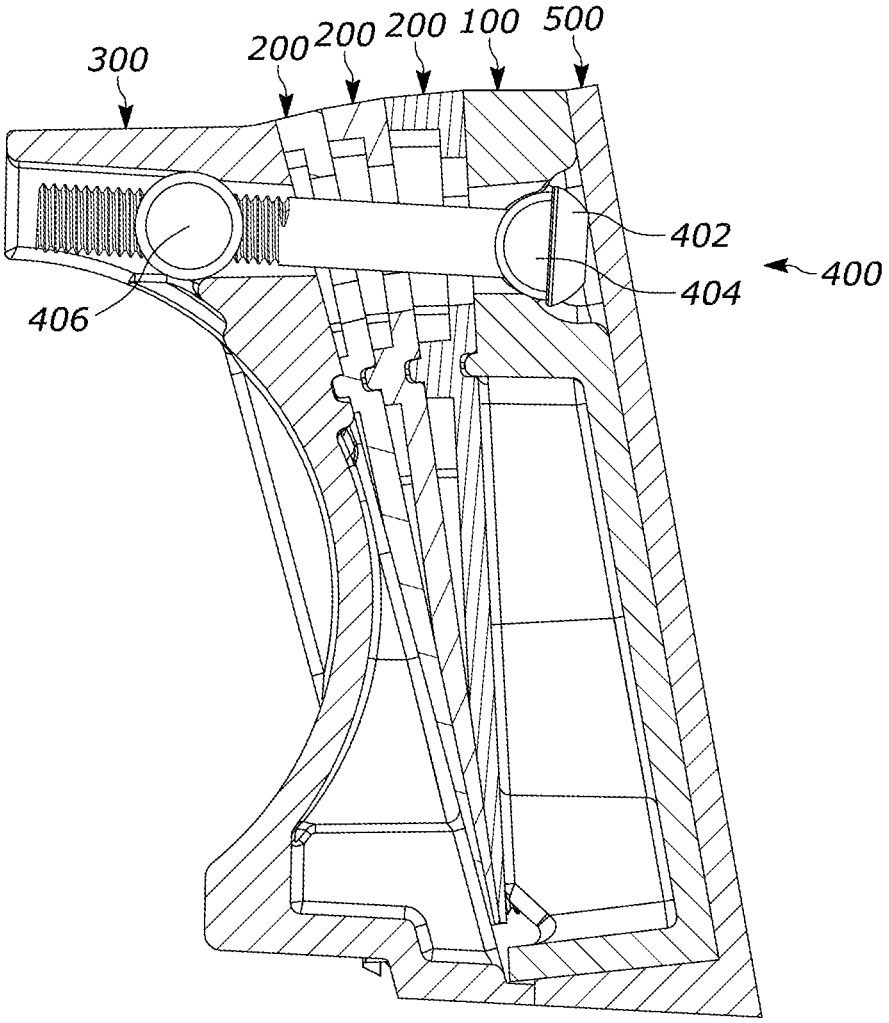
FIG. 11 is a cross section view of the assembly of the mounting plate assembly and system of FIG. 9 illustrating an upper clamping assembly.

FIG. 11 is a cross section view of the assembly of the mounting plate assembly and system of FIG. 9 illustrating an upper clamping assembly 400. The longitudinal axis of the lower threaded fastener 402 and the longitudinal axis of the upper threaded fastener 402 are not parallel. This is largely the result of the thickness of the shims 200. However, as mentioned in this disclosure, accommodating a wide range of angles is an advantage of this assembly 10.

Figure 12:
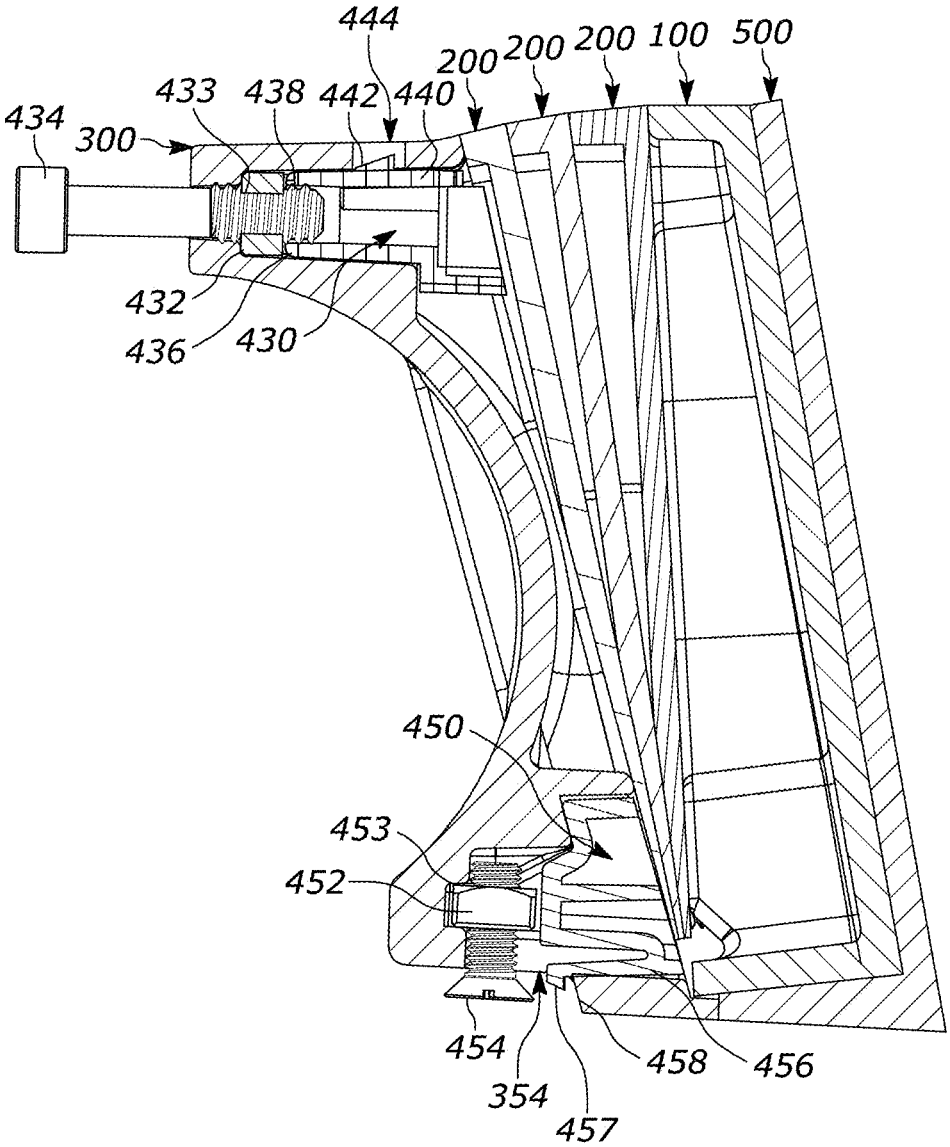
FIG. 12 is a cross section view of the assembly of the mounting plate assembly and system of FIG. 9 illustrating an upper nut retainer and a lower nut retainer.

FIG. 12 is a cross section view of the assembly of the mounting plate assembly and system of FIG. 9 illustrating an upper nut retainer 430 and a lower nut retainer 450. The configuration of these components greatly simplifies the design of the actuator plate 300 and overcomes the complexity of precisely embedding a nut or threaded bore in each of the horizontal and vertical planes of the actuator plate.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

It is understood that the preceding is merely a detailed description of some examples and embodiments of the present disclosure, and that numerous changes to the disclosed embodiments may be made in accordance with the disclosure made herein without departing from the spirit or scope of the disclosure.

The preceding description, therefore, is not meant to limit the scope of the disclosure but to provide sufficient disclosure to allow one of ordinary skill in the art to practice the disclosure without undue burden. It is further understood that the scope of the present disclosure fully encompasses other embodiments that may become obvious to those skilled in the art, and that the scope of the present disclosure is accordingly limited by nothing other than the appended claims.

Features illustrated or described as part of one embodiment can be used in another embodiment to yield a still further embodiment. Thus, it is intended that the present disclosure cover such modifications and variations as come within the scope of the appended claims and their equivalents. Other objectives, features and aspects of the present disclosure are disclosed in the following detailed description.

It is to be understood by one of ordinary skill in the art that the present discussion is a description of exemplary embodiments only and is not intended as limiting the broader aspects of the present disclosure, which broader aspects are embodied in the exemplary constructions.

Although the present disclosure and its advantages have been described in detail, it should be understood that various changes, substitutions and alterations can be made herein without departing from the spirit and scope of the disclosure as defined in the appended claims.

The invention claimed is:

1. An assembly adapted for mounting a water engagement device to a marine vessel, the assembly comprising:

a transom plate having a front surface that is adapted to be connected to the marine vessel and a bottom side;

an actuator plate having a front surface and a flange extending from the front surface, wherein the flange is disposed under the bottom side of the transom plate;

a wedge pack including at least one shim disposed between the transom plate and the actuator plate; and a clamping assembly that engages the transom plate and the actuator plate to connect the actuator plate to the transom plate and, when tightened, compresses the wedge pack between the actuator plate and transom plate.

2. The assembly of claim 1, wherein the actuator plate further comprises an upper coupling pocket including a nut and an upper nut retainer disposed therein and an upper coupling opening formed therein that extends through a back surface of the actuator plate and is registered in alignment with an opening in the nut so that the upper coupling opening and the nut opening are adapted to receive a fastener therethrough.

3. The assembly of claim 2, wherein the upper nut retainer includes a back surface having an opening defined therein that is registered in alignment with the opening through the nut.

4. The assembly of claim 2, wherein the upper nut retainer is cantilever snap-fit into the upper coupling pocket.

5. The assembly of claim 1, wherein the actuator plate further comprises a lower coupling pocket including a nut and a lower nut retainer disposed therein and a lower coupling opening formed therein that extends through a bottom side of the actuator plate and is registered in alignment with an opening in the nut so that the lower coupling opening and the nut opening are adapted to receive a fastener therethrough.

6. The assembly of claim 5, wherein the lower nut retainer is cantilever snap-fit into the lower coupling pocket.

7. An assembly adapted for mounting a water engagement device to a marine vessel, the assembly comprising:

a transom plate having a front surface that is adapted to be connected to the marine vessel, an opposed rear surface and a bottom side;

an actuator plate having a front surface and a bottom side that extends beyond the front surface to define a flange, wherein the bottom side of the transom plate is disposed above the flange;

a clamping assembly that connects the actuator plate to the transom plate, and, when tightened, the rear surface of the transom plate is disposed adjacent to the front surface of the actuator plate.

8. The assembly of claim 7, further comprising a wedge pack including at least one shim disposed between the transom plate and actuator plate, wherein the wedge pack is compressed between the actuator plate and the transom plate.

9. The assembly of claim 7, wherein the actuator plate further comprises an upper coupling pocket including a nut and an upper nut retainer disposed therein and an upper coupling opening formed therein that extends through a back surface of the actuator plate and is registered in alignment with an opening in the nut so that the upper coupling opening and the nut opening are adapted to receive a fastener therethrough.

10. The assembly of claim 9, wherein the upper nut retainer includes a back surface having an opening defined therein that is registered in alignment with the opening through the nut.

11. The assembly of claim 9, wherein the upper nut retainer is cantilever snap-fit into the upper coupling pocket.

12. The assembly of claim 7, wherein the actuator plate further comprises a lower coupling pocket including a nut and a lower nut retainer disposed therein and a lower coupling opening formed therein that extends through a bottom side of the actuator plate and is registered in alignment with an opening in the nut so that the lower coupling opening and the nut opening are adapted to receive a fastener therethrough.

13. The assembly of claim 12, wherein the lower nut retainer is cantilever snap-fit into the lower coupling pocket.

14. A marine vessel comprising:

a transom;

a transom plate having a front surface, a rear surface, and a bottom side extending between the front surface and rear surface, where the front surface is connected to the transom;

an actuator plate having a front surface and a ledge, where the bottom side of the transom plate disposed adjacent the rear surface of the transom plate is disposed above the ledge;

a wedge pack including at least one shim disposed between the transom plate and the actuator plate; and a clamping assembly that, when tightened, forces the actuator plate and the wedge pack against the rear surface of the transom plate.

15. The marine vessel of claim 14, wherein the transom plate includes a plurality of projections disposed on and extending from the front surface into contact with the transom.

16. The marine vessel of claim 14, further comprising a positioning fastener connected to the transom and disposed in a positioning opening formed in the transom plate.

17. A method of installing an assembly adapted for mounting a water engagement device to a transom of a marine vessel, the method comprising the steps of:

measuring an angle of the transom with respect to a bottom surface of the marine vessel adjacent the transom;

selecting at least one shim for a wedge pack based on the angle of the transom;

installing a positioning fastener into engagement with the transom;

compressing the assembly including the wedge pack disposed between the transom plate and an actuator plate with a clamping assembly;

aligning a positioning opening formed in the transom plate over the positioning fastener; and affixing adhesively the compressed assembly to the transom.

* * * * *